US012527415B2

(12) United States Patent
Hansen

(10) Patent No.: US 12,527,415 B2
(45) Date of Patent: Jan. 20, 2026

(54) MUSICAL BOOSTER SEAT DEVICE

(71) Applicant: Erik Hansen, Enterprise, AL (US)

(72) Inventor: Erik Hansen, Enterprise, AL (US)

( * ) Notice: Subject to any disclaimer, the term of this patent is extended or adjusted under 35 U.S.C. 154(b) by 244 days.

(21) Appl. No.: 18/234,443

(22) Filed: Aug. 16, 2023

(65) Prior Publication Data

US 2025/0057328 A1 Feb. 20, 2025

(51) Int. Cl.
*A47D 1/10* (2006.01)
*A63H 5/00* (2006.01)

(52) U.S. Cl.
CPC ..... *A47D 1/103* (2013.01); *A63H 5/00* (2013.01)

(58) Field of Classification Search
CPC ..... A47D 1/103; A63H 5/00; A47C 9/08
USPC ..... 297/250.1, 256.17, 186, 217.3, 217.4, 297/217.1, 217.5, 217.6
See application file for complete search history.

(56) References Cited

U.S. PATENT DOCUMENTS 504,071 A * 8/1893 Wascinski ..... A47B 39/00 108/34
4,521,052 A * 6/1985 Cone ..... A47D 1/103 297/DIG. 2
D283,855 S 5/1986 Kujawski
5,385,075 A 1/1995 Carnes
5,490,711 A * 2/1996 Pollock ..... A47D 13/102 297/188.08
5,560,679 A 10/1996 Barnholdt
6,491,343 B2 12/2002 Yamazaki
6,721,430 B2 * 4/2004 Wang ..... H04R 5/023 381/301
7,383,789 B2 * 6/2008 Wilkes ..... A01K 1/0272 119/28.5
7,692,083 B2 4/2010 Aspland
8,115,088 B2 2/2012 Herrera
8,668,045 B2 * 3/2014 Cohen ..... H04R 5/04 181/150
8,936,309 B1 * 1/2015 Hanlon ..... A47D 1/103 108/50.01
11,160,379 B2 11/2021 Hohn
2003/0067198 A1 * 4/2003 Treen ..... A47D 1/103 297/250.1
2008/0100108 A1 * 5/2008 Fullmer ..... A47D 1/00 297/217.4

(Continued)

FOREIGN PATENT DOCUMENTS

WO WO2005116987 8/2005
WO WO-2020035995 A1 * 2/2020 ..... H04R 1/025

*Primary Examiner* — Jose V Chen

(57) ABSTRACT

A musical booster seat device for supporting and entertaining a child includes a housing having a top wall, a bottom wall, and a peripheral wall extending between the top wall and the bottom wall to define an interior space. A window is positioned in the peripheral wall. The peripheral wall has a vent extending therethrough, with a mesh grill covering the vent. A plurality of instruments is positioned within the interior space. The plurality of instruments is visible through the window and is audible through the vent. Alternative embodiments may include a speaker and an electronic sound emitter that function together with the plurality of instruments. The electronic sound emitter may include a transceiver, a memory unit, and a central processing unit so that pre-recorded sounds or songs can be played audibly with the speaker. Some embodiments include lights that are controlled by the central processing unit.

8 Claims, 7 Drawing Sheets

(56) References Cited

U.S. PATENT DOCUMENTS

| | | | | |
|---|---|---|---|---|
| 2009/0152910 | A1* | 6/2009 | Lee | A47C 7/727<br>74/5.6 R |
| 2009/0295202 | A1* | 12/2009 | Takada | H04R 1/028<br>297/217.4 |
| 2010/0084901 | A1* | 4/2010 | Flannery | A47D 1/103<br>297/250.1 |
| 2010/0244516 | A1* | 9/2010 | Fiore, Jr. | A47D 1/103<br>297/250.1 |
| 2010/0320819 | A1* | 12/2010 | Cohen | A61H 23/0236<br>381/104 |
| 2011/0304181 | A1* | 12/2011 | Scott | A47D 15/006<br>297/250.1 |
| 2012/0305414 | A1* | 12/2012 | Magnus | F25D 11/00<br>297/217.4 |
| 2023/0191989 | A1* | 6/2023 | Dotzler | B60N 2/508<br>297/217.6 |

* cited by examiner

MUSICAL BOOSTER SEAT DEVICE

ROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to booster seats and more particularly pertains to a new booster seat for supporting and entertaining a child.

(2) Description of Related Art Including Information Disclosed Under 37 CFR 1.97 and 1.98

The prior art relates to booster seats. Many prior art booster seats are designed to safely secure a toddler or child on a chair, for example boosting the toddler or child up to an appropriate height for using a nearby table. They are typically formed of combinations of durable, easy-to-clean materials, sometimes with padding to improve the child's comfort. Some designs include arm rests, back rests, and other modifications. However, these booster seat disclosures focus on the safety and physical comfort of the child. While those considerations are important, the prior art fails to disclose a booster seat with the added functionality of a toy or other entertainment device. Thus, there is a need in the art for a booster seat that can both support and entertain the child.

BRIEF SUMMARY OF THE INVENTION

An embodiment of the disclosure meets the needs presented above by generally comprising a housing having a top wall, a bottom wall, and a peripheral wall extending between the top wall and the bottom wall to define an interior space. A window is positioned in the peripheral wall. The peripheral wall has a vent extending therethrough, with a mesh grill covering the vent. A plurality of instruments is positioned within the interior space. The plurality of instruments is visible through the window and is audible through the vent. Alternative embodiments may include a speaker and an electronic sound emitter that function in concert with the instruments. The electronic sound emitter may include a transceiver, a memory unit, and a central processing unit so that pre-recorded sounds or songs can be played audibly with the speaker. Some embodiments include lights that are controlled by the central processing unit.

There has thus been outlined, rather broadly, the more important features of the disclosure in order that the detailed description thereof that follows may be better understood, and in order that the present contribution to the art may be better appreciated. There are additional features of the disclosure that will be described hereinafter, and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
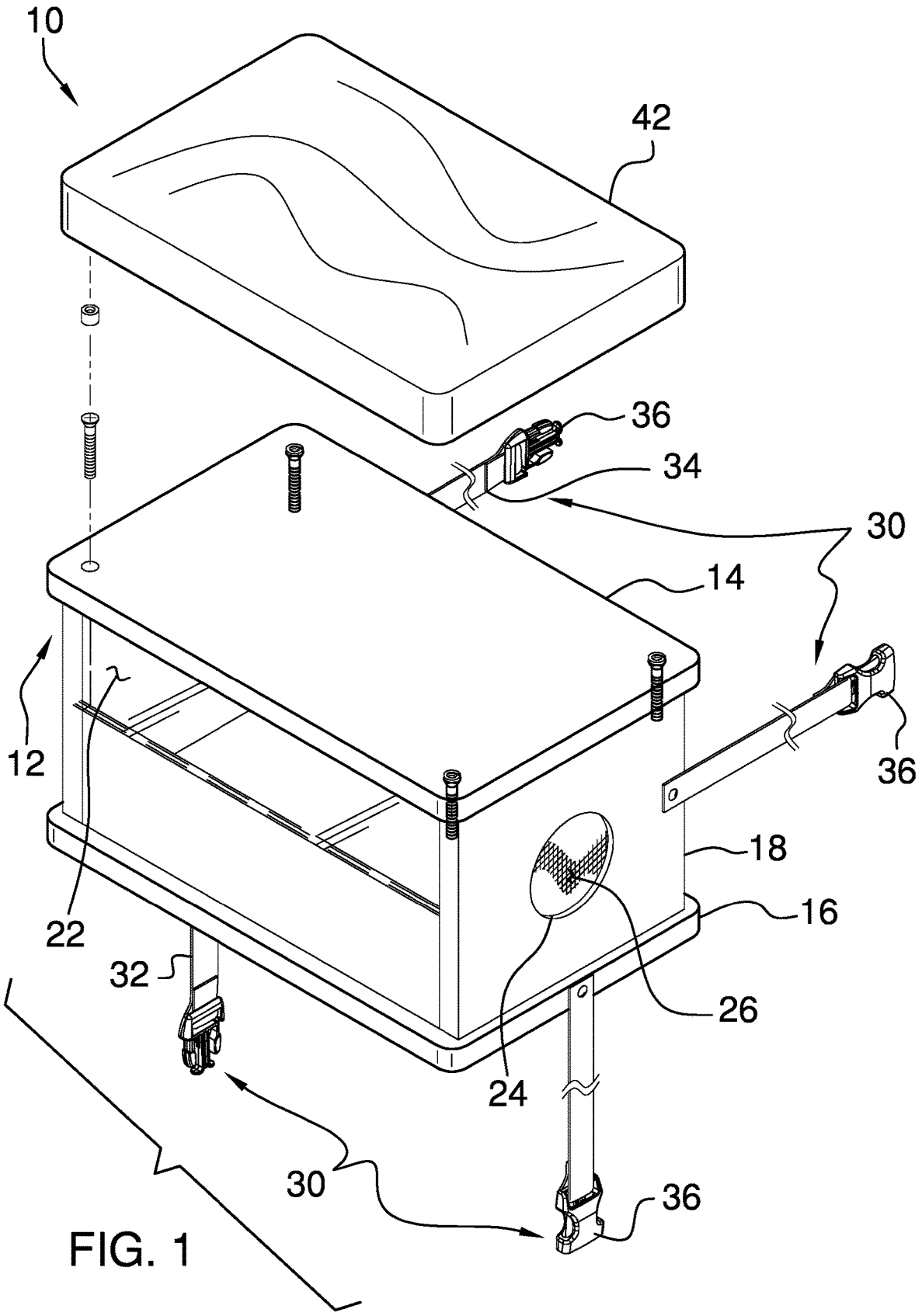
FIG. 1 is an isometric view of a musical booster seat device according to an embodiment of the disclosure.
Figure 2:
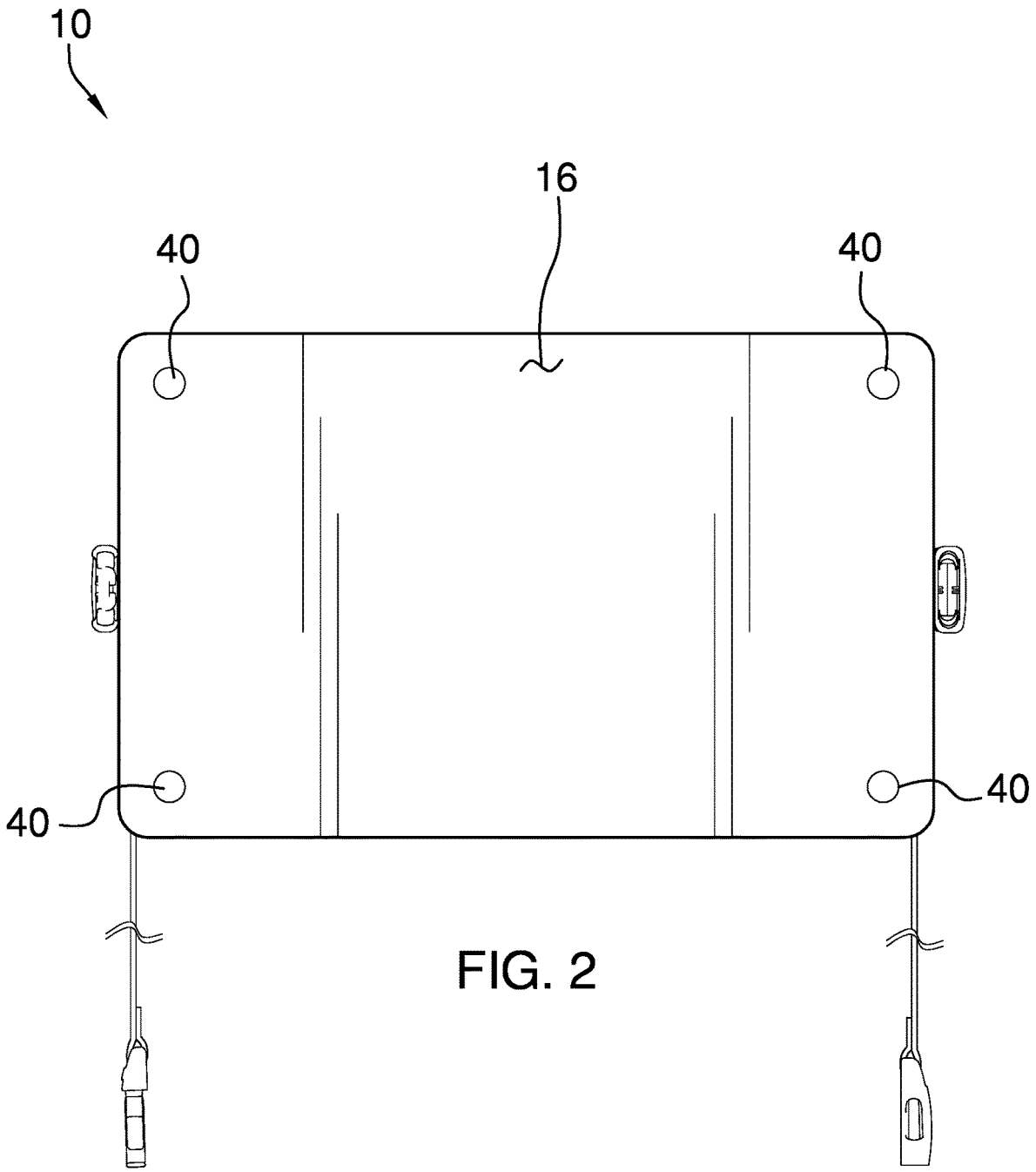
FIG. 2 is a bottom view of an embodiment of the disclosure.
Figure 3:
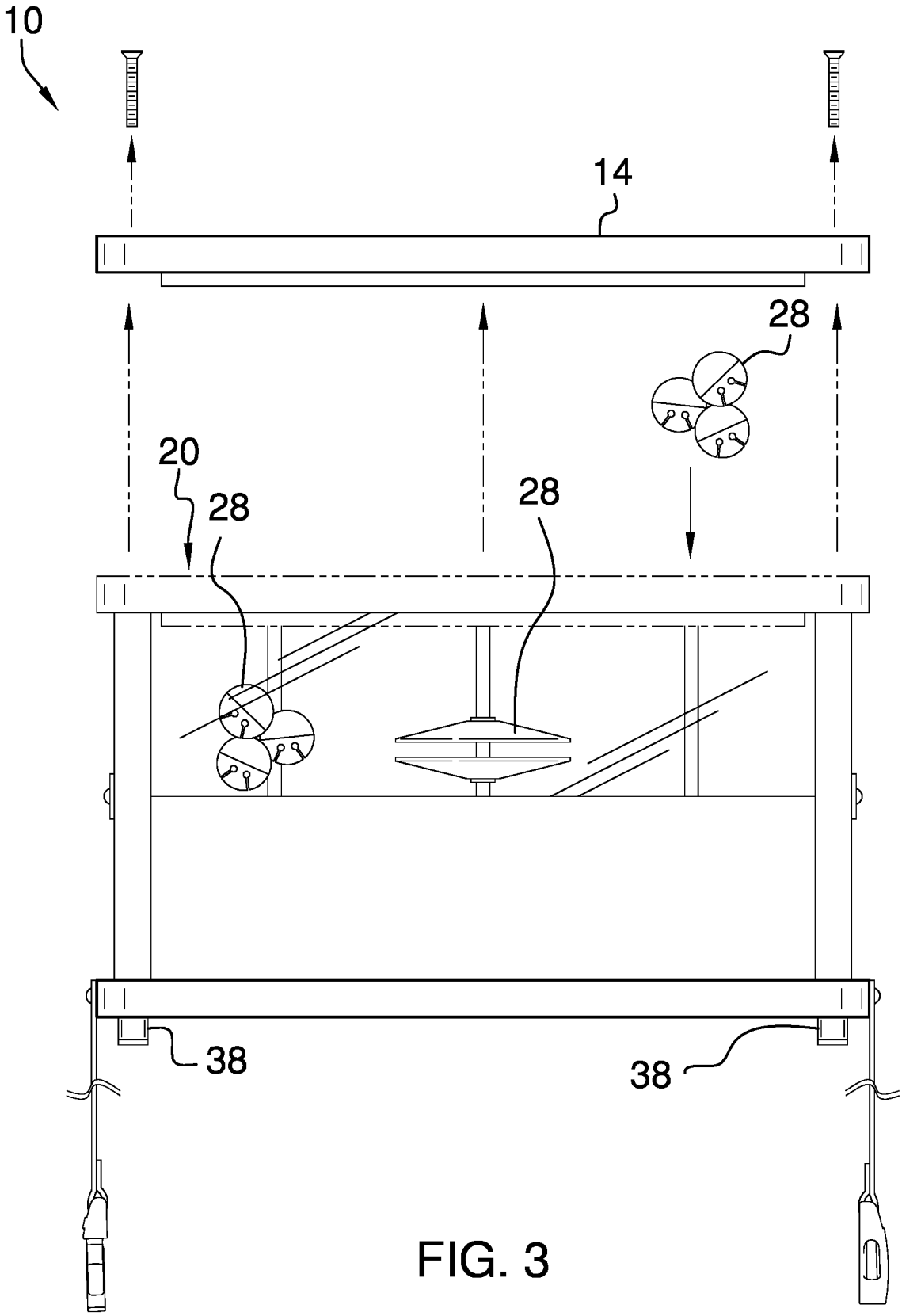
FIG. 3 is a front view of an embodiment of the disclosure.
Figure 4:
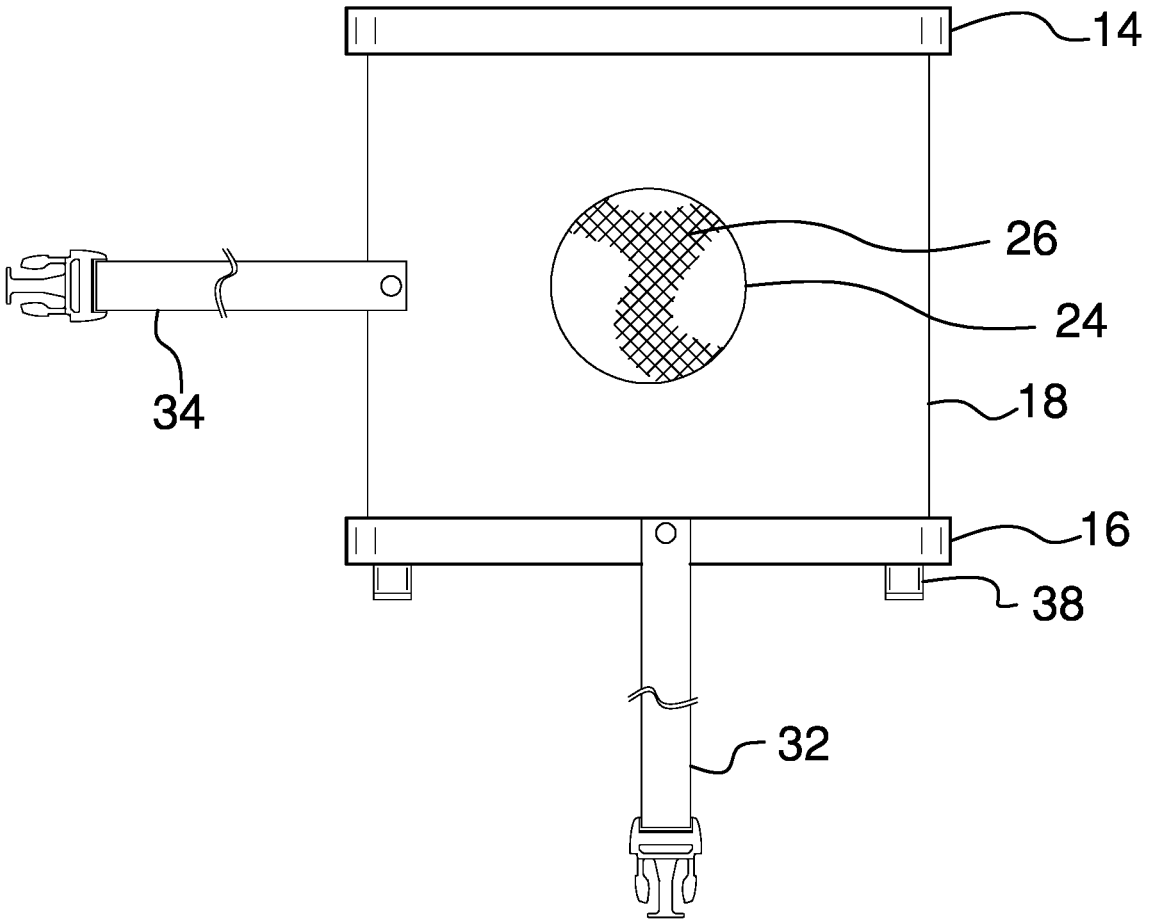
FIG. 4 is a side view of an embodiment of the disclosure.
Figure 5:
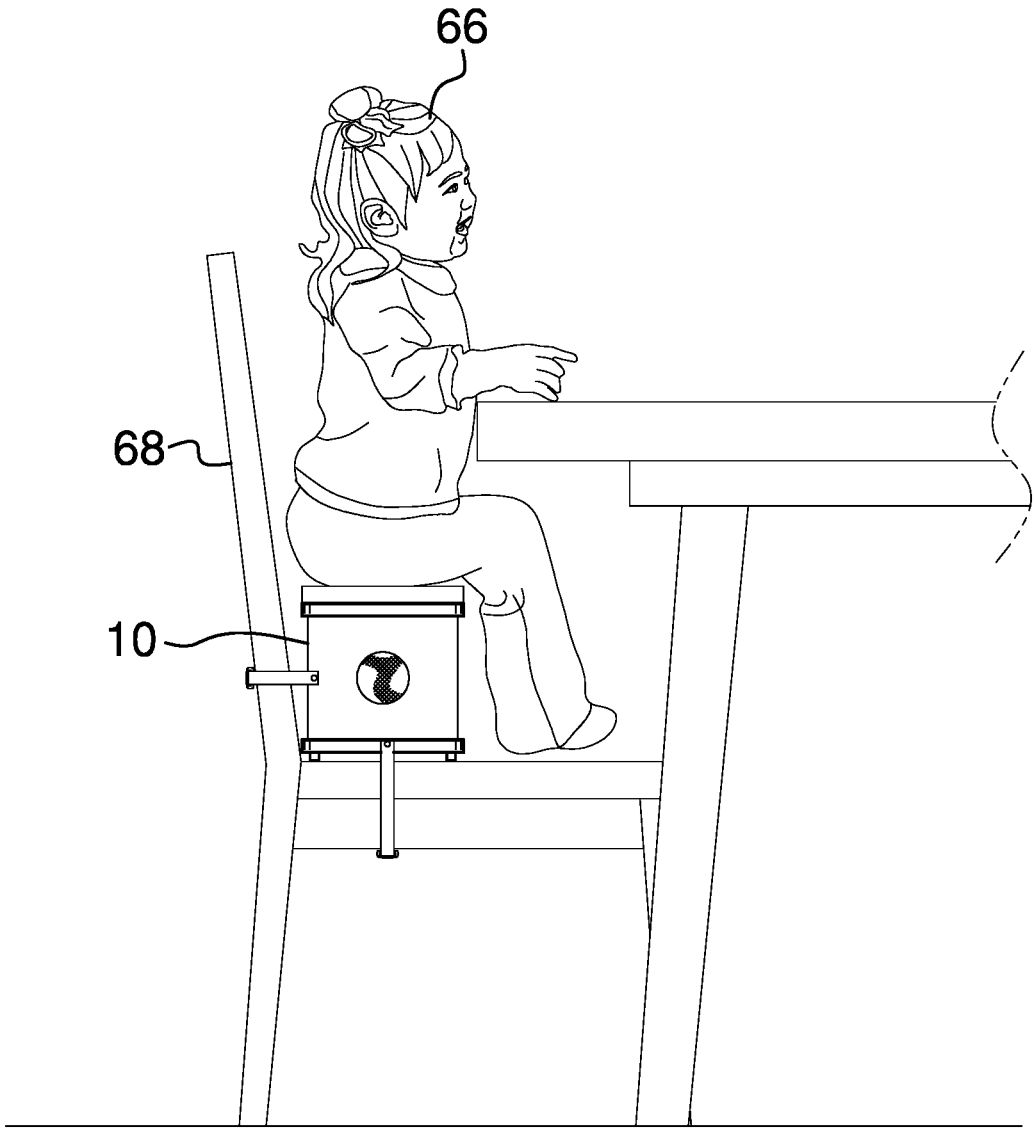
FIG. 5 is an in-use view of an embodiment of the disclosure.

With reference now to the drawings, and in particular to FIGS. 1 through 7 thereof, a new booster seat embodying the principles and concepts of an embodiment of the disclosure and generally designated by the reference numeral 10 will be described.

As best illustrated in FIGS. 1 through 7, the musical booster seat device 10 generally comprises a housing 12 having a top wall 14, a bottom wall 16, and a peripheral wall 18 extending between the top wall 14 and the bottom wall 16 to define an interior space 20. The housing 12 should be durable and capable of supporting a child user's weight on the top wall 14. For example, the housing 12 should be able to support a weight of at least 20 pounds.

As shown in FIG. 1, a cushion 42 may be removably secured to the top wall 14. The cushion 42 can be the same shape as the top wall 14. The top wall 14 may also have the same shape as the bottom wall 16. For example, the bottom wall 16, top wall 14, and cushion 42 may all be rectangular. However, other shapes or configurations are also contemplated, for example where the top wall 14 has a different shape than the bottom wall 16 or the cushion 42. One such example is a rectangular bottom wall 16, a triangular top wall 14, and a circular cushion 42. Different users may prefer different shape configurations of the housing 12 and the cushion 42.

A window 22 is positioned in the peripheral wall 18. For example, the window 22 may comprise a durable transparent material, such as plexiglass. Said peripheral wall 18 has a vent 24 extending therethrough. In the embodiments depicted in FIGS. 1, 4, and 5, a mesh grill 26 may cover the vent 24.

A plurality of instruments 28 is positioned within the interior space 20. The plurality of instruments 28 is visible through the window 22 and is audible through the vent 24. In embodiments, the plurality of instruments 28 may comprise musical instruments, including bells, metal bars, cymbals, chimes, metal plates, ball bearings, and horns. The plurality of instruments 28 are positioned within the interior space 20 such that at least one of the plurality of instruments 28 makes a sound, or emits a noise, when the housing 12 is moved or when a percussive force is applied to the housing 12. For example, if the plurality of musical instruments 28 includes bells, the bells should ring when a user 66 shakes or strikes the housing 12.

In some embodiments, the top wall 14 is removably attached to the peripheral wall 18. The plurality of instruments 28 may also be removably mounted to the housing 12 within the interior space 20. Such embodiments are shown most clearly in FIG. 3. In such embodiments, the top wall 14 may be removed to change the plurality of instruments 28, for example by replacing the instruments with alternative options or adding additional instruments into the interior space 20.

The musical booster seat device 10 further comprises a plurality of straps 30 attached to the housing 12 and configured to removably attach the housing 12 to a chair 68. The plurality of straps 30 generally includes a bottom strap 32 that is affixed to the bottom wall 16. The bottom strap 32 extends outwardly from the bottom wall 16. In some embodiments, the bottom strap 32 has an adjustable length. The plurality of straps 30 may also include a side strap 34 that is affixed to the peripheral wall 18. The side strap 34 extends outwardly from the peripheral wall 18. For example, the side strap 34 may be attached to the peripheral wall 18 adjacent to the vent 24. The side strap 34 may also have an adjustable length. In the embodiments depicted, each of the bottom 32 and side 34 straps have a break therein to define a pair of strap portions. A plurality of fasteners 36 is attached to each of the strap portions such that the strap portions are releasably secured together. For example, the fasteners 36 may include buckles, clips, or any other appropriate fastening structure.

The musical booster seat device 10 may further comprise a plurality of legs 38 attached to the bottom wall 16. The plurality of legs 38 extends downwardly from the bottom wall 16. For example, the plurality of legs 38 may be formed of a smooth and tapered material that will not splinter, fracture, or break and thereby risk injury to the user 66. A plurality of non-skid pads 40 may also be included, for example each of the plurality of legs 38 may have one of the plurality of non-skid pads 40 attached thereto.

Figure 6:
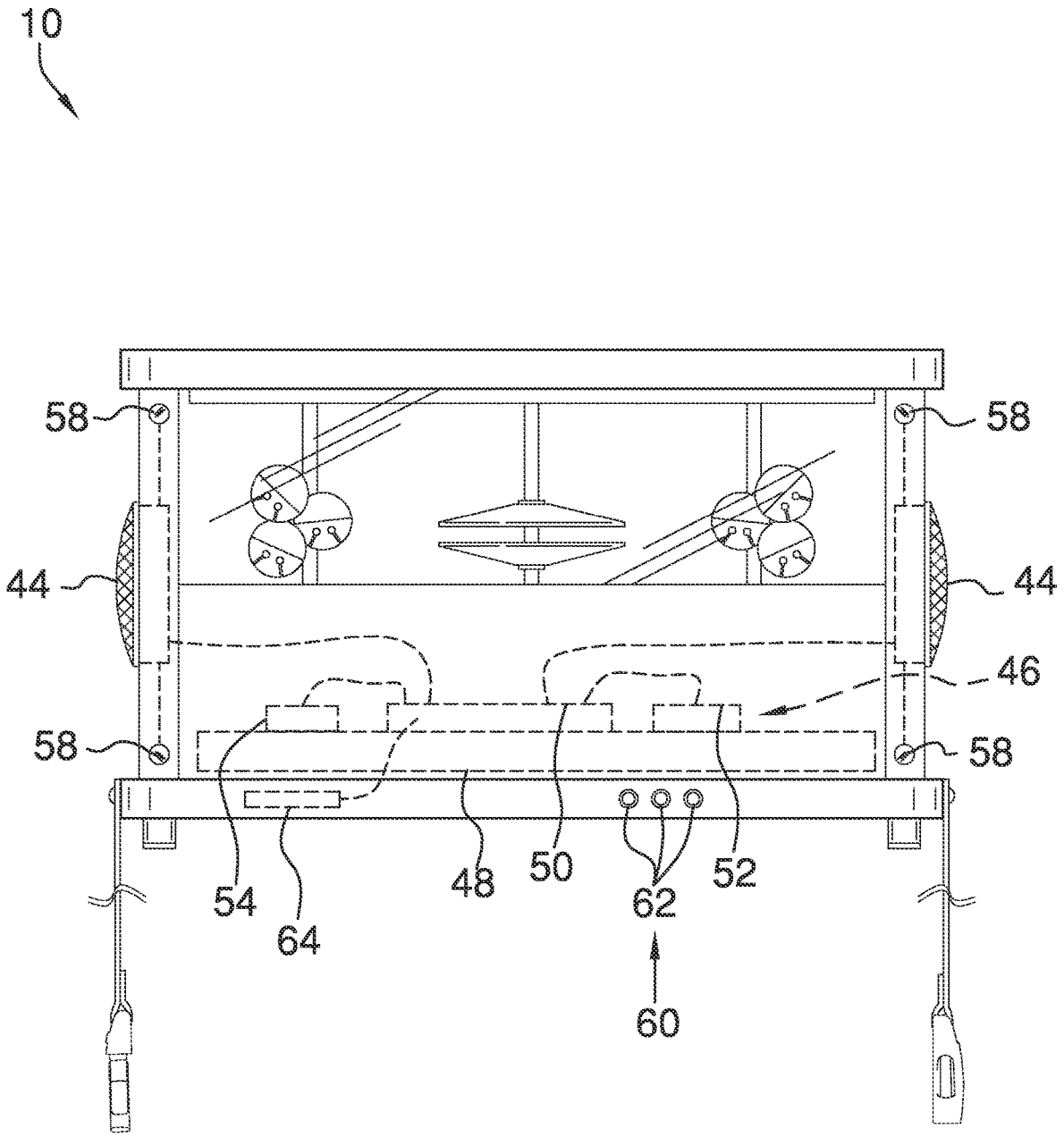
FIG. 6 is a front view of an alternative embodiment of the disclosure.
Figure 7:
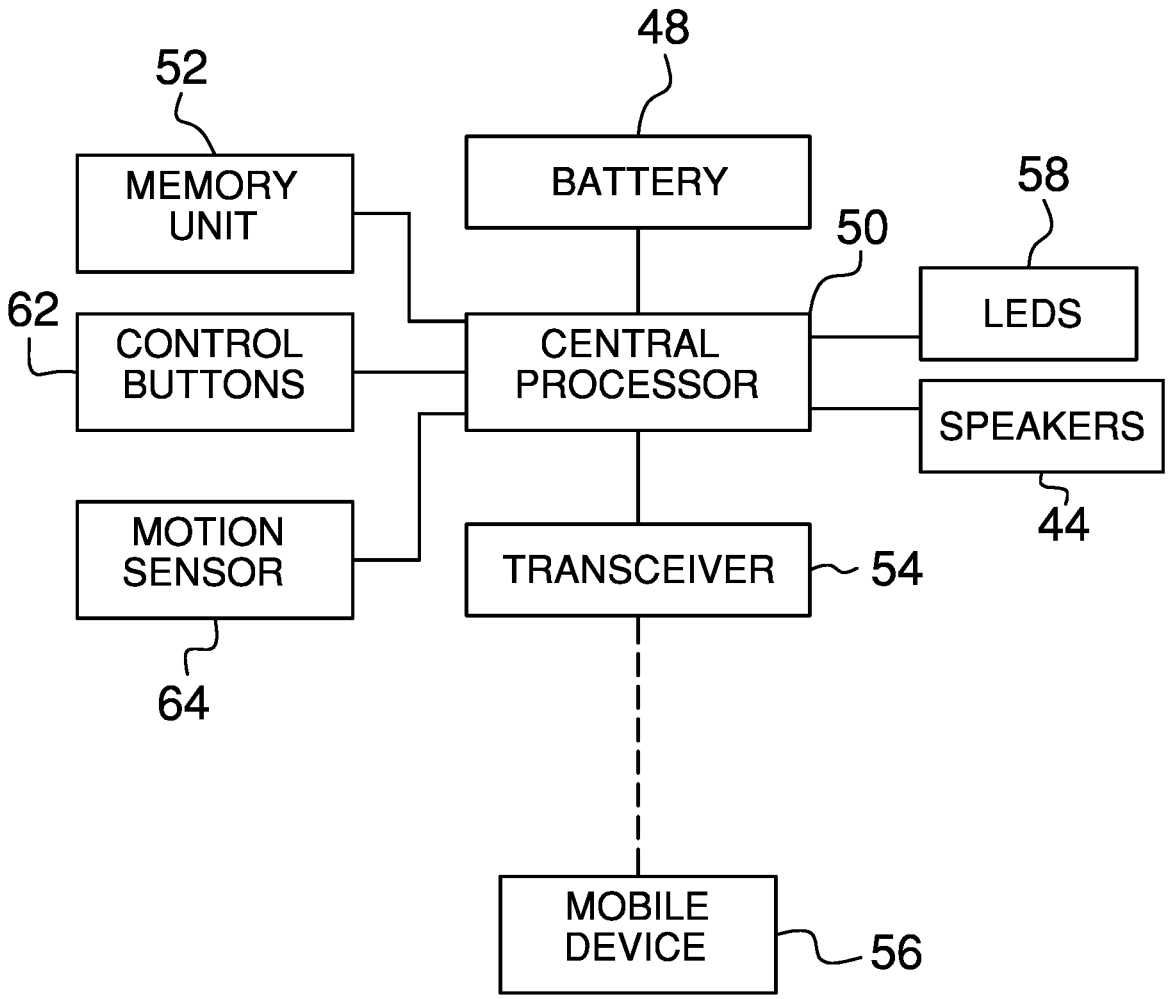
FIG. 7 is a block diagram view of an alternative embodiment of the disclosure.

An alternative embodiment is depicted in FIGS. 6 and 7. In such embodiments, the mesh grill 26 is replaced with a speaker 44 that is positioned in the peripheral wall 18. A sound emitter 46 is positioned within the interior space 20. The sound emitter 46 includes a battery 48 that is positioned within the interior space 20. For example, the battery 48 may be mounted to the bottom wall 16. A central processing unit 50 is also positioned within the interior space 20. The central processing unit 50 is electronically coupled to the battery 48. The central processing unit 50 is in communication with the battery 48. The speaker 44 is also in electronic communication with the central processing unit 50.

A memory unit 52 may be positioned within the interior space 20. The memory unit 52 is electrically coupled to the central processing unit 50. A plurality of sounds and songs may be stored on the memory unit 52. Said central processing unit 50 is configured to access the plurality of sounds and songs, and to play at least one of the plurality of sounds or songs audibly with the speaker 44.

A transceiver 54 may be positioned within the interior space 20. The transceiver 54 is electrically coupled to the central processing unit 50. The transceiver 54 is configured to communicate with an external electronic device 56. For example, the transceiver 54 may be configured to receive a recording from the external electronic device 56. In such embodiments, the memory unit 52 may be configured to store the recording. Said central processing unit 50 is configured to access the recording and to play the recording audibly with the speaker 44.

A plurality of lights 58 is positioned on the housing 12. The plurality of lights 58 is directed outwardly away from the housing 12, for example from the peripheral wall 18 as shown in FIG. 6. The plurality of lights 58 is electronically coupled to and controlled by the central processing unit 50. Said central processing unit 50 is configured to illuminate the plurality of lights 58 synchronously with at least one of the plurality of sounds, the plurality of songs, or the recording. Each of the plurality of lights 58 may be a light emitting diode.

A control 60 may be positioned on the housing 12 and is electronically coupled to the central processing unit 50. The control 60 is configured to actuate the central processing unit 50. The control 60 is also configured to turn on and off the speaker 44 and the plurality of lights 58. The control 60 may also be configured to adjust a volume of the speaker 44, or to change a selection of the sounds, songs, or recording is played with the speaker 44. In the embodiment depicted in FIG. 6, the control 60 comprises a plurality of buttons 62 mounted to the bottom wall 16. In other embodiments, the control 60 may comprise alternative structures, such as a touch screen or an arrangement of switches and dials. In other embodiments, there may not be a control 60 positioned on the housing 12, and the sound emitter 46 may instead be controlled externally, for example using the external electronic device 56.

A motion sensor 64 is positioned in the interior space 20. The motion sensor 64 is electronically coupled to the central processing unit 50. The central processing unit 50 is configured to play at least one of the plurality of sounds, the plurality of songs, or the recording when the motion sensor 64 detects a movement of the housing 12.

As with the embodiment in FIGS. 1-5, the plurality of instruments 28 are positioned within the interior space 20. The plurality of instruments 28 is visible through the window 22 and audible from within the housing 12. When the housing 12 is moved or struck, the plurality of instruments 28 create noise and music, which can supplement the sounds, songs, or recording is played with the sound emitter 46.

In use, the musical booster seat device 10 may be used as a booster seat or as a musical instrument or toy for a child or toddler. The child can sit on top of the musical booster seat device 10 while shaking, hitting, or tapping the device 10 to create music with the plurality of instruments 28. The child can play along with their favorite sounds, songs, or recordings that are played through the speaker 44 using the sound emitter 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A booster seat comprising:

a housing having a top wall, a bottom wall, and a peripheral wall extending between the top wall and the bottom wall to define an interior space;

a window being positioned in the peripheral wall;

the peripheral wall having a vent extending therethrough;

a mesh grill covering the vent;

a plurality of instruments being positioned within the interior space, the plurality of instruments being visible through the window and being audible through the vent; and a plurality of straps being attached to the housing and being configured to removably attach the housing to a chair, the plurality of straps including:

a bottom strap being affixed to the bottom wall, the bottom strap extending outwardly from the bottom wall, the bottom strap having an adjustable length;

a side strap being affixed to the peripheral wall, the side strap extending outwardly from the peripheral wall, the side strap having an adjustable length;

each of the bottom and side straps having a break therein to define a pair of strap portions; and a plurality of fasteners being attached to the strap portions such that the strap portions are releasably secured together.

2. The booster seat of claim 1, the window further comprising a transparent plexiglass material.

3. The booster seat of claim 1, the plurality of instruments including bells, metal bars, cymbals, chimes, metal plates, ball bearings, and horns.

4. The booster seat of claim 1, wherein at least a one of the plurality of instruments emits a noise in response to a movement of the housing.

5. The booster seat of claim 1, wherein at least a one of the plurality of instruments emits a noise in response to a percussive force on the housing.

6. A booster seat comprising;

a housing having a top wall, a bottom wall, and a peripheral wall extending between the top wall and the bottom wall to define an interior space;

a window being positioned in the peripheral wall;

the peripheral wall having a vent extending therethrough;

a mesh grill covering the vent;

a plurality of instruments being positioned within the interior space, the plurality of instruments being visible through the window and being audible through the vent; and wherein the top wall is removably attached to the peripheral wall, and wherein the plurality of instruments is removably mounted to the housing within the interior space.

7. The booster seat of claim 1, further comprising a plurality of legs being attached to the bottom wall, the plurality of legs extending downwardly from the bottom wall; and a plurality of non-skid pads, each of the plurality of legs having one of the plurality of non-skid pads attached thereto.

8. A musical booster seat being configured for removable attachment to a chair, the musical booster seat comprising:

a housing having a top wall, a bottom wall, and a peripheral wall extending between the top wall and the bottom wall to define an interior space, the top wall being removably attached to the peripheral wall, the housing supporting a weight on the top wall of at least 20 pounds;

a cushion being removably secured to the top wall, the cushion having a same shape as the top wall;

the top wall having a same shape as the bottom wall, the bottom wall being rectangular;

a window being positioned in the peripheral wall;

a speaker being positioned in the peripheral wall;

a sound emitter being positioned within the interior space, the sound emitter comprising:

a battery being positioned within the interior space, the battery being mounted to the bottom wall;

a central processing unit being positioned within the interior space, the central processing unit being coupled to the battery, the central processing unit being in communication with the battery;

a memory unit being positioned within the interior space, the memory unit being electrically coupled to the central processing unit;

a plurality of sounds being stored on the memory unit;

a plurality of songs being stored on the memory unit;

a transceiver being positioned within the interior space and being electrically coupled to the central processing unit, the transceiver being configured to communicate with an external electronic device;

the transceiver being configured to receive a recording from the external electronic device;

the memory unit being configured to store the recording;

the speaker being in electronic communication with the central processing unit;

the central processing unit being configured to access the plurality of sounds and the plurality of songs, the central processing unit being configured to play at least one of the plurality of sounds or the plurality of songs audibly with the speaker;

the central processing unit being configured to access the recording, the central processing unit being configured to play the recording audibly with the speaker;

a plurality of lights being positioned on the housing, the plurality of lights being directed outwardly away from the peripheral wall, the plurality of lights being electronically coupled to and controlled by the central processing unit, each of the plurality of lights being a light emitting diode, the central processing unit being configured to illuminate the plurality of lights synchronously with at least one of the plurality of sounds, the plurality of songs, or the recording;

a control being positioned on the housing and being electronically coupled to the central processing unit, the control being configured to actuate the central processing unit, the control being configured to turn on and off the speaker and the plurality of lights, the control being configured to adjust a volume of the speaker, the control comprising a plurality of buttons, the plurality of buttons being mounted to the bottom wall;

a motion sensor being positioned in the interior space, the motion sensor being electronically coupled to the central processing unit, the central processing unit being configured to play at least one of the plurality of sounds, the plurality of songs, or the recording when the motion sensor detects a movement of the housing;

a plurality of musical instruments being removably mounted to the housing, the plurality of musical instruments being positioned within the interior space, the plurality of musical instruments being visible through the window, the plurality of musical instruments including bells, metal bars, cymbals, chimes, metal plates, ball bearings, and horns;

a plurality of straps being attached to the housing and being configured to removably attach the housing to the chair, the plurality of straps including:

a bottom strap being affixed to the bottom wall, the bottom strap extending outwardly from the bottom wall, the bottom strap having an adjustable length;

a side strap being affixed to the peripheral wall, the side strap extending outwardly from the peripheral wall, the side strap being positioned adjacent to the speaker, the side strap having an adjustable length;

each of the bottom and side straps having a break therein to define a pair of strap portions;

a plurality of fasteners being attached to the strap portions such that the strap portions are releasably secured together;

a plurality of legs being attached to the bottom wall, the plurality of legs extending downwardly from the bottom wall, the plurality of legs being formed of a smooth and tapered material; and a plurality of non-skid pads, each of the legs having one of the non-skid pads attached thereto.

* * * * *